US005265962A

United States Patent [19]

Ogawa et al.

[11] Patent Number: 5,265,962

[45] Date of Patent: Nov. 30, 1993

[54] PACKING BAG HAVING DRAWSTRINGS

[75] Inventors: Hiroshi Ogawa; Teruo Takinoue, both of Osaka, Japan

[73] Assignee: The Pack Kabushiki Kaisha, Osaka, Japan

[21] Appl. No.: 7,579

[22] Filed: Jan. 22, 1993

Related U.S. Application Data

[63] Continuation-in-part of Ser. No. 765,156, Sep. 23, 1991, abandoned.

[30] Foreign Application Priority Data

Apr. 9, 1991 [JP] Japan ..... 3-23111

[51] Int. Cl.[5] ..... B65D 33/28

[52] U.S. Cl. ..... 383/75; 383/71

[58] Field of Search ..... 383/71, 74, 75, 93, 383/96, 107

[56] References Cited

U.S. PATENT DOCUMENTS 298,152 5/1884 Arkell .
405,068 6/1989 Arkell .
2,982,659 5/1961 Mote .
3,196,757 7/1965 Samways .
3,547,341 12/1970 Kirkpatrick .
3,552,639 1/1971 Meyer .
3,738,567 6/1973 Ruda .
3,738,568 6/1973 Ruda .
4,832,507 5/1989 Herrington .
4,842,421 6/1989 Bullard et al. .

FOREIGN PATENT DOCUMENTS 508087 3/1975 Japan .
1321107 6/1989 Japan .

*Primary Examiner*—Stephen P. Garbe
*Attorney, Agent, or Firm*—Collard & Roe

[57] ABSTRACT

A packing bag comprises a flat main body made of a synthetic resin film or sheet, sleeves formed around a top end of the main body and each divided into upper and lower chambers, and drawstrings each inserted in the respective chambers of each sleeve. A plurality of engaging portions in the form of knurled indentations are formed between the upper and lower chambers and below the lower chambers so that an increased friction and a reduced stiffness are imparted to the sleeve, in such manner that after the top end portions are gathered by pulling the drawstrings in opposite directions, the increased friction and reduced stiffness prevent the top end from opening unintentionally due to a possible resilient restoration of its ungathered state.

2 Claims, 9 Drawing Sheets

PACKING BAG HAVING DRAWSTRINGS

This is a continuation-in-part application of co-pending application U.S. Ser. No. 07/765,156 filed Sep. 23, 1991 now abandoned.

BACKGROUND OF THE INVENTION

1. Field of the Invention

The invention relates to a packing bag which has drawstrings, and more particularly relates to a packing bag having one or more drawstrings which are inserted in a sleeve formed around and along an open top end of a main body of the packing bag, wherein the drawstrings are capable of being pulled in opposite directions respectively at their opposite side ends so that an upper portion of the packing bag is gathered to close the open top end.

2. Description of Prior Art

In such a conventional type of packing bag as shown in FIG. 15, upper portions of a bag's flat main body 51 made of a thermoplastic resin film are folded over such that the upper portions' extremities are thermally welded respectively to a front and back walls 52 and 52 of the packing bag's main body 51. A front and back sleeves 53 and 53 for accommodating drawstrings are formed in this manner to extend around an open top end of the bag. An upper and lower drawstrings 54 and 54 inserted in each sleeve 53 will be tightened to close the open top end (see for example Japanese Patent Publication Hei. 1-32170 and Japanese Utility Model Publication Sho 50-8087). An end of one drawstring 54 and an opposite end of the other drawstring 54 are pulled in opposite directions to gather the upper portions so as to close the bag as shown in FIG. 16.

It is however to be noted that the tightened ends of the drawstrings 54 are likely to slacken while the bag is suspended from a user's hand and carried by him, or when the drawstrings are knotted one with the other. As a result, the binding force of the drawstrings 54 becomes so weak that the resiliency of the resin film will loosen the tightly gathered top end to open.

OBJECT AND SUMMARY OF THE INVENTION

An object of the present invention which was made in view of the drawbacks mentioned above is therefore to provide a packing bag having drawstrings, which bag can maintain its closed state of open top end if the top end portion is once gathered and closed by tightening the drawstrings, even if the binding force thereof were weakened thereafter, whereby the packing bag can surely hold any articles in it and can be manufactured advantageously in a mechanical process.

Other objects and advantages of the invention will become apparent hereinafter from the description of the preferred embodiments which are given only in way of example allowing any suitable modifications to be included in the scope and spirit of the invention.

Those objects referred to above will be accomplished by providing a packing bag having drawstrings, which bag comprises: (a) a main body made of synthetic resin film or sheet and having sleeves formed around an open top end of the bag so as to accommodate the drawstrings; (b) each drawstring being of an annular shape, inserted in the sleeves around the open top end and capable of being tightened to gather and close it; (c) a plurality of engaging portions formed on surfaces of the sleeves, with the engaging portions increasing a friction between the surfaces which come into contact with one another in a gathered state of the bag's top end, and further with the engaging portions being such that stiffness of the sleeves is reduced to render them less restorable to their ungathered state; (d) wherein the engaging portions are knurled indentations which are formed longitudinally of the sleeves, at predetermined intervals and in parallel with each other; (e) wherein each sleeve comprises a tab extending from the top end and a front or back wall of the main body, which wall has a surface opposite to the tab; (f) wherein each sleeve is formed by tightly welding the wall to the tab at its lower end and middle zone extending longitudinally of the sleeves, whereby a lower junction line and a middle junction line are formed, with the middle junction line dividing the sleeve into an upper internal chamber and a lower internal chamber; (g) wherein each sleeve accommodates an upper drawstring and a lower drawstring which are disposed above and below the middle junction line, respectively; (h) wherein each sleeve has as the engaging portions a plurality of parallel indentations formed at predetermined intervals along the sleeve, and wherein bottoms of the indentations extend into the tab so that the tab is securely connected to the wall; (i) wherein the bottoms of the indentations are fusion-welded integral with each other, and (j) wherein each drawstring is welded integral with the sleeve but separable therefrom at one end to provide the sleeve with an operable portion, whereas at other end opposite to the operable portion of each drawstring it is permanently attached to the sleeve.

DETAILED DESCRIPTION OF PREFERRED EMBODIMENTS

Figure 1:
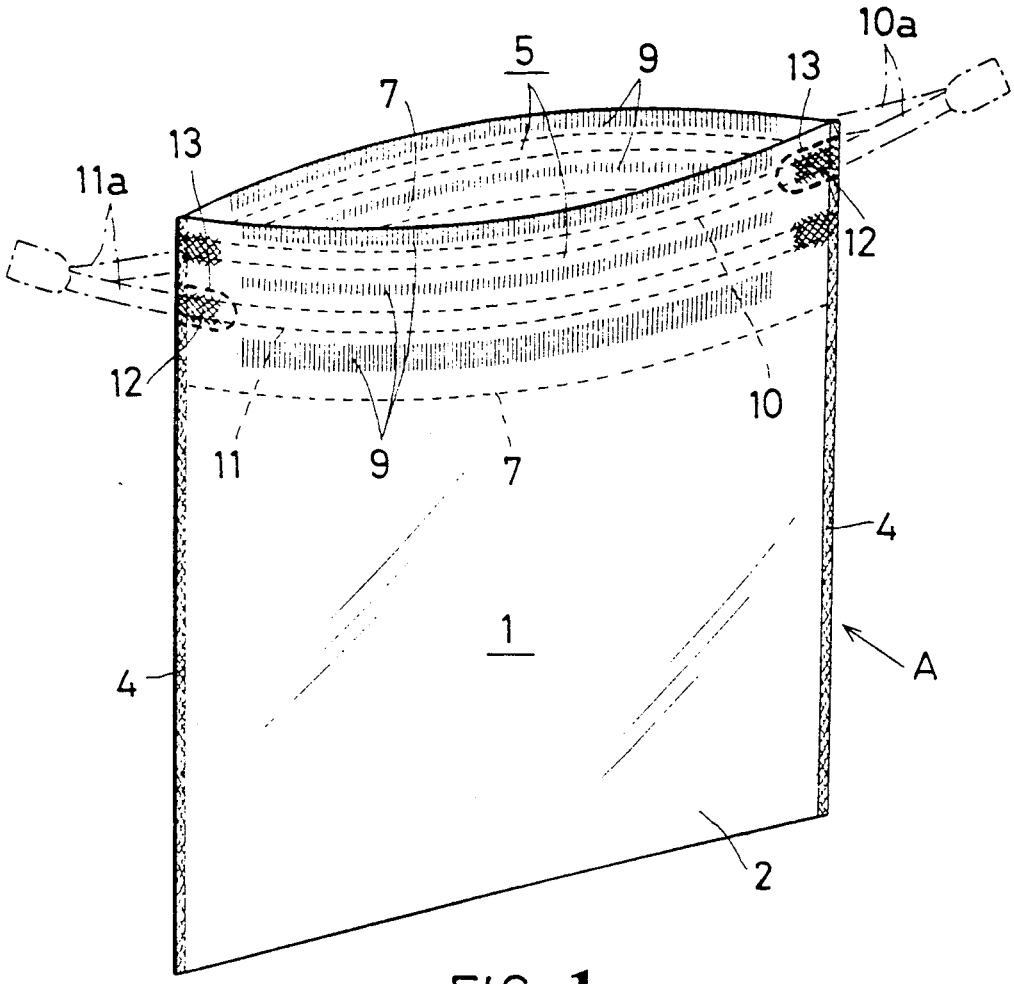
FIG. 1 is a perspective view showing a packing bag with drawstrings provided in an embodiment of the invention.

The invention will now be described more in detail referring to the preferred embodiment shown in FIGS. 1 to 14.

The word "front" and "back" are meant in this description to respectively indicate this side facing an observer and the other behind said side of a packing bag.

The packing bag comprises a main body 1 and a pair of drawstrings 10 and 11.

The main body 1 flat in shape and having an open top end is formed by folding a thermoplastic resin film and by thermally welding right and left edges of front and back walls 2. The thermoplastic resin film as the material of the main body 1 renders it easy to manufacture the packing bag. Though polyethylene is one of the most preferable thermoplastic resins, any other resin may be employed. The reference numeral 4 denotes welded stripes.

Front and back sleeves 5 and 5 for accommodation of drawstrings are formed near the open top end of the main body 1.

Figure 2:
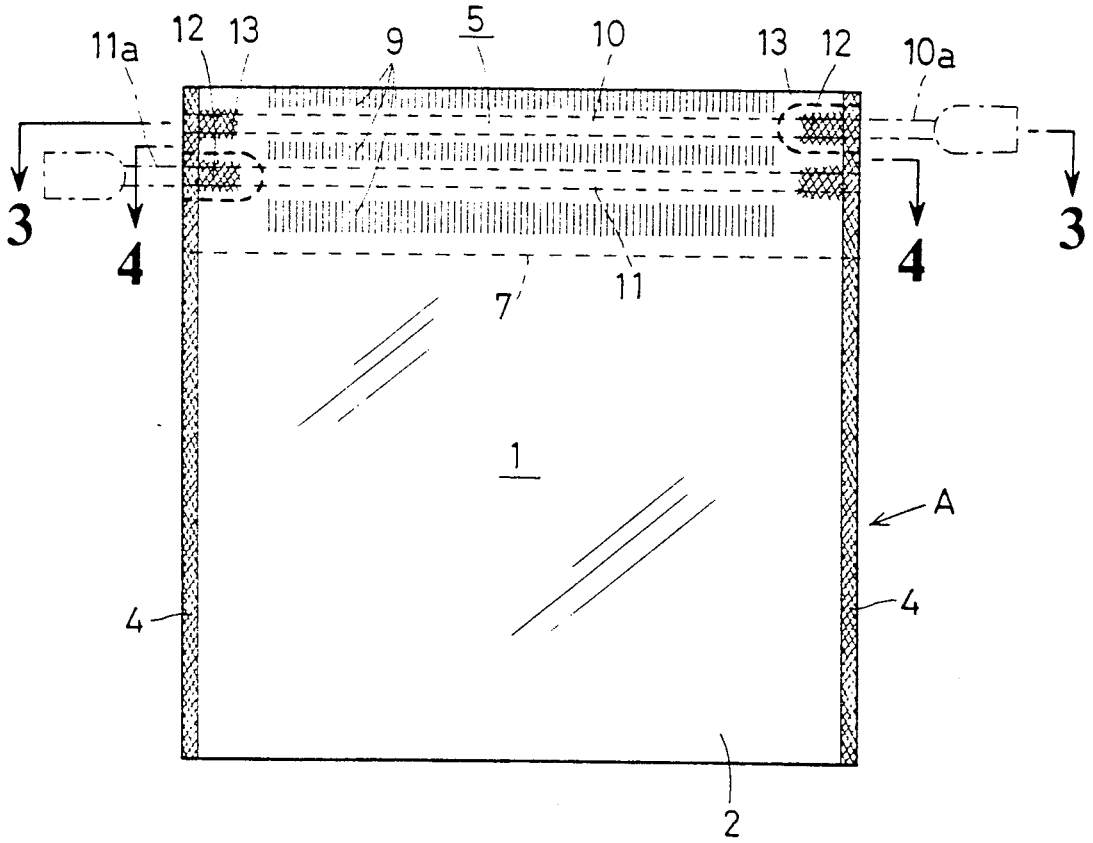
FIG. 2 is a front elevation of the packing bag in the embodiment.
Figure 3:
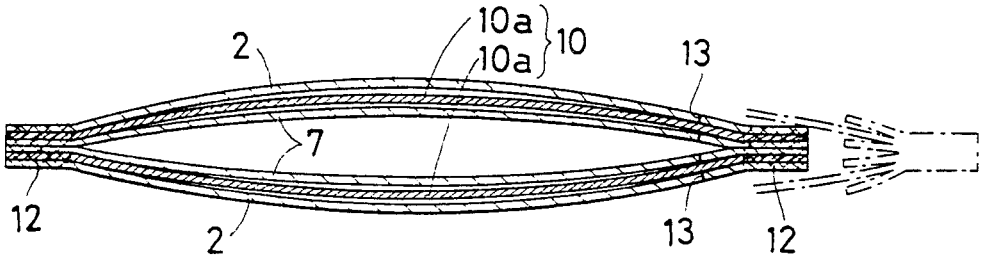
FIG. 3 is a cross section taken along the line 3—3 in FIG. 2.
Figure 4:
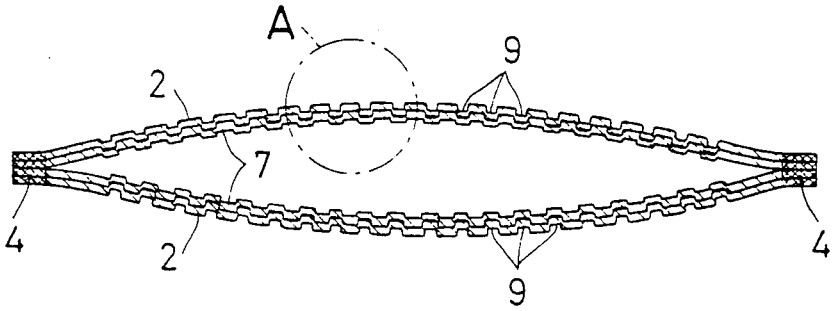
FIG. 4 is another cross section taken along the line 4—4 in FIG. 2.
Figure 5:
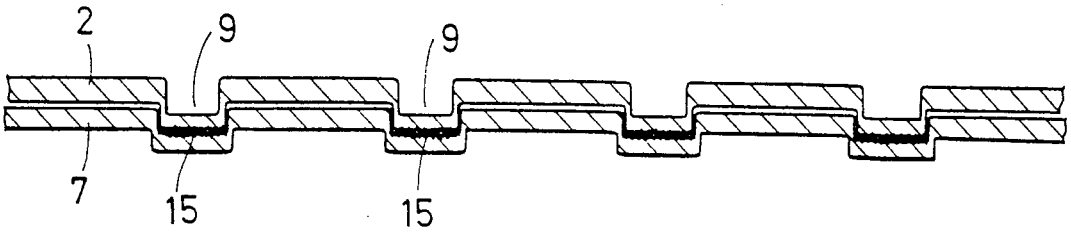
FIG. 5 is an enlarged cross section of the part "A" in FIG. 4.
Figure 6:
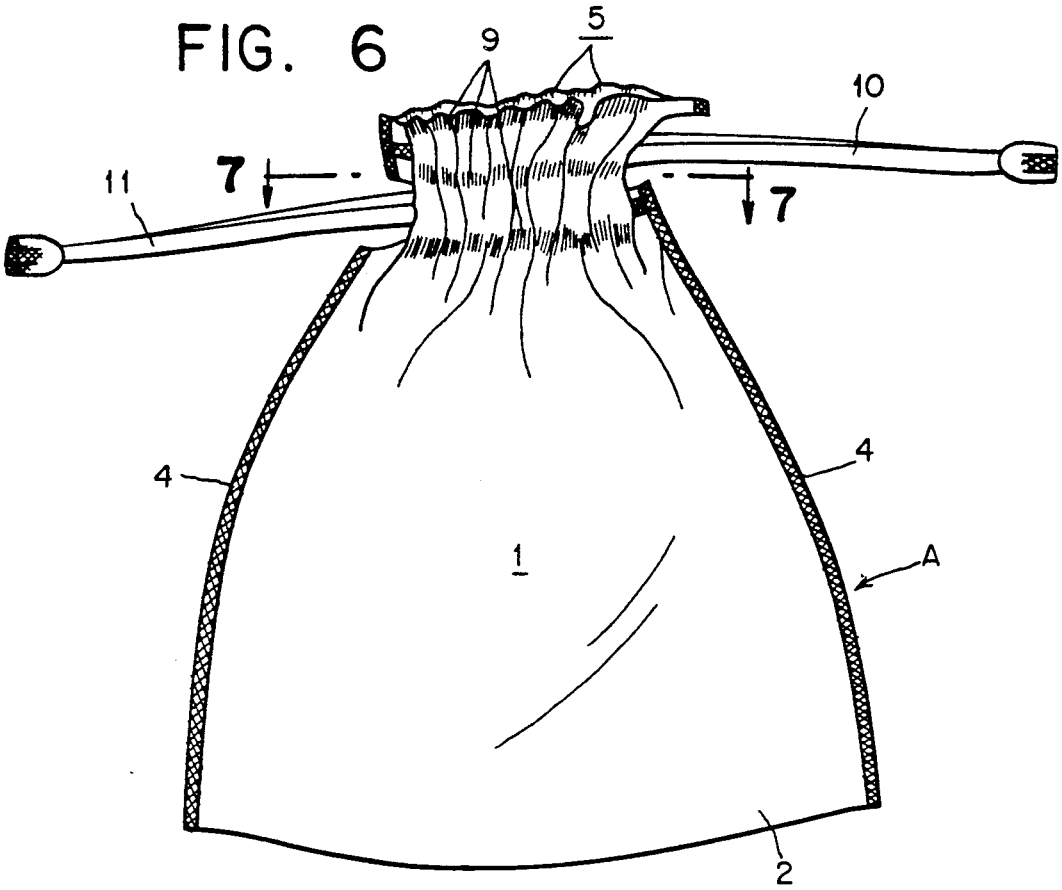
FIG. 6 is a perspective view showing the bag in the embodiment, in its entirety and with its top end being gathered.
Figure 7:
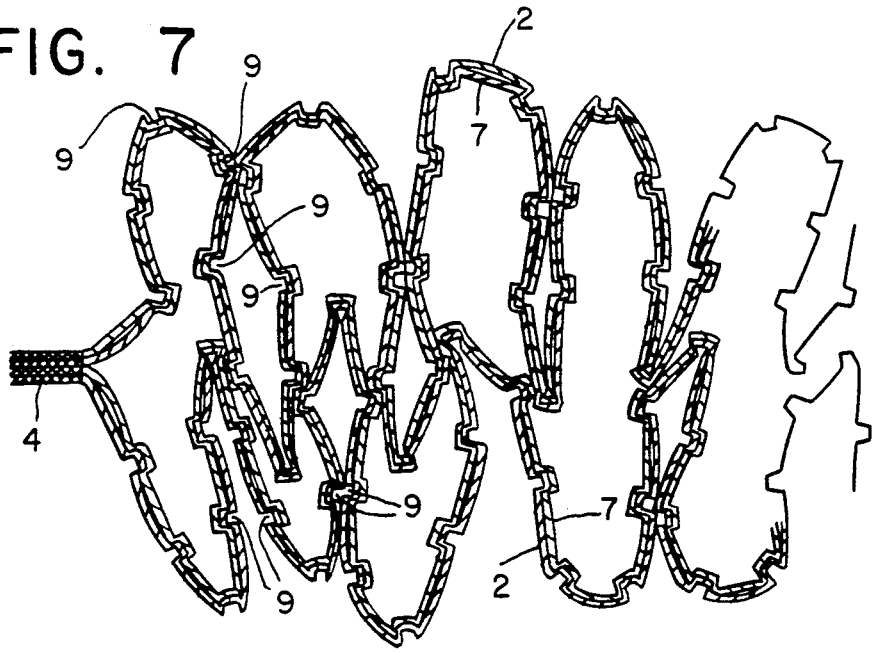
FIG. 7 is an enlarged cross section taken along the line 7—7 in FIG. 6.

Tabs 7 extending from upper edges of the front and back walls 2 are folded inwards and secured thereto along upper, middle and lower junction lines each of a given width to thereby form the sleeves 5. The bonding of the tabs is carried out by knurling them through the outer walls 2 along the three band-like junction lines. Many indentations 9 are thus formed as shown in FIGS. 2, 4 and 5 wherein their bottoms are fusion-welded to a surface of each tab in such a manner as shown in FIG. 5. The reference numeral 15 in FIG. 5 denotes the thus welded portions. The indentations 9 forming the middle junction line will substantially divide each sleeve 5 into upper and lower chambers which are disposed above and below the middle junction line, respectively. It is noted that right and left side edges of each sleeve 5 are in a sealed state due to the welded stripes 4, before the bag is used. The fine and thin indentations serving as a plurality of engaging portions, extend perpendicular to the sleeves and disposed in parallel with each other and at regular intervals, so that an increased friction is imparted by the engaging portions to the gathered sleeve's 5 surfaces in contact with one another, wherein the engaging portions reduce the stiffness of the sleeves and thereby render them less capable of elastic restoration of shape in their gathered state. The knurling process mentioned above is performed while the bag under manufacture is heated, so that the folded tabs 7 will advantageously be fusion-welded to the front or back walls 2 at their indentations 9. The engaging portions need not be of any particular shape and dimension, insofar as they increase the friction between the contacting surfaces of the gathered sleeves 5, and insofar as they decrease the sleeves' stiffness and make it difficult for them to elastically restore their shape so as to open the top end of the bag.

One end of the front or back sleeve 5 accommodating upper and lower drawstrings 10 and 11 serves as an operable portion, while the other end, which is opposite to the one end, of the back or front sleeve 5 also accommodating the drawstrings 10 and 11 serves as a further operable portion. These operable portions are pulled outwards in opposite directions to gather and close the top end of the bag.

Each of the upper and lower drawstrings 10 and 11 is composed of a pair of front and back constituent strings 10*a* and 10*a*, or 11*a* and 11*a*, which are narrow ribbons made of a suitable thermoplastic resin. Each pair of the constituent strings 10*a* or 11*a* is welded at its side extremities integral with each other and also integral with the sleeves 5. It will be advantageous to employ a suitable thermoplastic resin to form the constituent strings 10*a* and 1*a*, because they can readily be welded to each other and to the sleeves. Although an example of preferable thermoplastic resins is polyethylene, any other resin may be used. The reference numeral 12 denotes welded areas of the strings.

Breakable joints 13 are provided around the welded areas 12 which are located at one side extremity of one drawstring 10 or 11 and at the other opposite side extremity of the other drawstring 11 or 10. Such breakable joints 13 will be torn off when the welded areas 12 are pinched and pulled outwards, whereby these welded areas can serve as the operable portions of the drawstrings 10 and 11 when they are tightened. Alternatively, any suitable cutouts exposing the extremities may be provided in place of the breakable joints 13.

The packing bag as described above may preferably be manufactured for example in a continuous manner, as follows.

Figure 8:
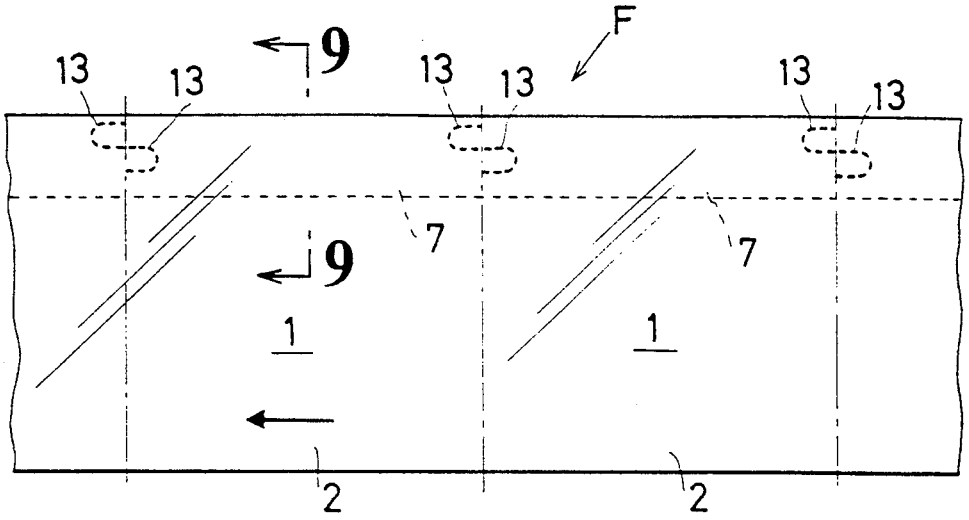
FIG. 8 is a plan view showing the first step of manufacturing the bag in the embodiment.
Figure 9:
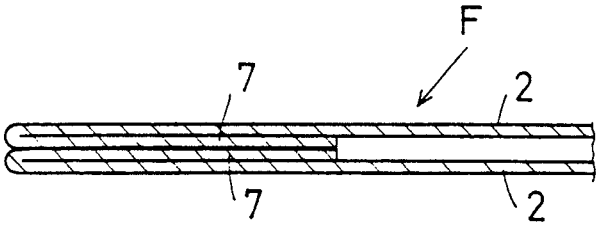
FIG. 9 is an enlarged cross section taken along the line 9—9 in FIG. 8.

At first a raw material "F", which is a thermoplastic resin film having a predetermined width and is wound on an uncoiler (not shown), will be unwound to be doubled over transversely along its longitudinal center line in a manner shown in FIG. 8. Side free portions of the thus formed front and back walls 2 are folded back inwards to provide tabs 7 and 7. Upper and lower U-shaped breakable joints 13 having their legs extending sideways are formed on the inwardly folded side portions, and disposed one above another at right and left sides of each phantom line, respectively. Each perforation defining such joints 13 pierces the tab 7 and the front or back wall 2 which is in contact with the tab.

It will be convenient to draw the letter "S" with a broken line, i.e., perforation, across each dot-and-dash phantom line in order to form the breakable joints 13 in such a manner shown in FIG. 8.

Figure 10:
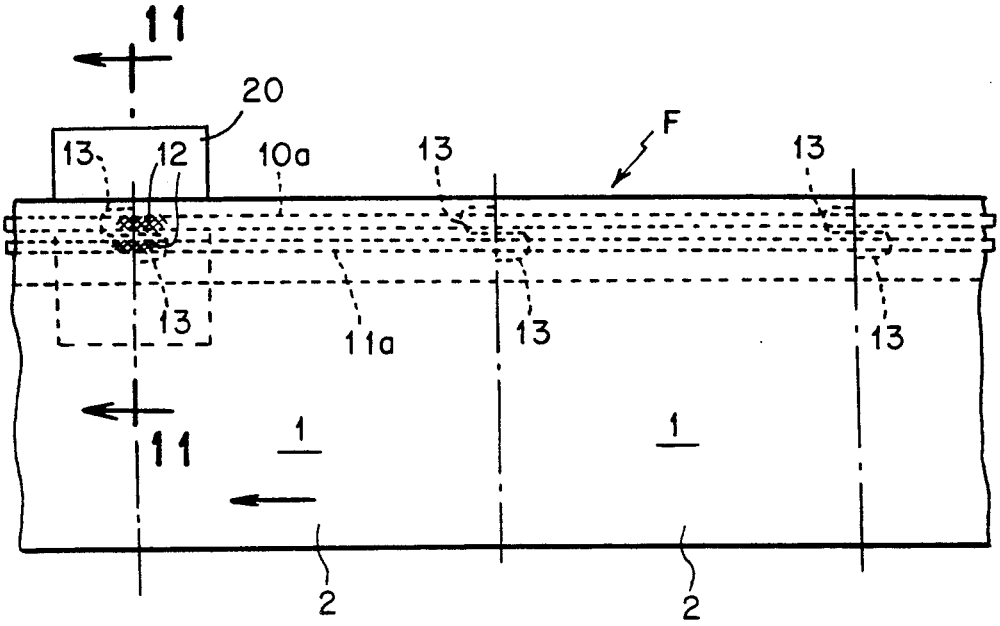
FIG. 10 is a plan view showing the second step which follows the first step shown in FIG. 8 and is carried out to manufacture the bag in the embodiment.
Figure 11A:
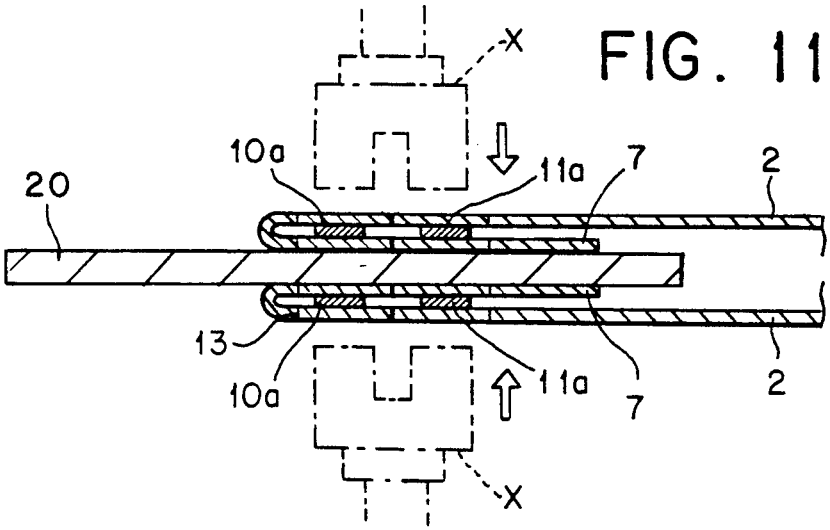
FIG. 11A is an enlarged cross section of the portion which extends along the line 11—11 in FIG. 10 but is not fusion-welded yet.
Figure 11B:
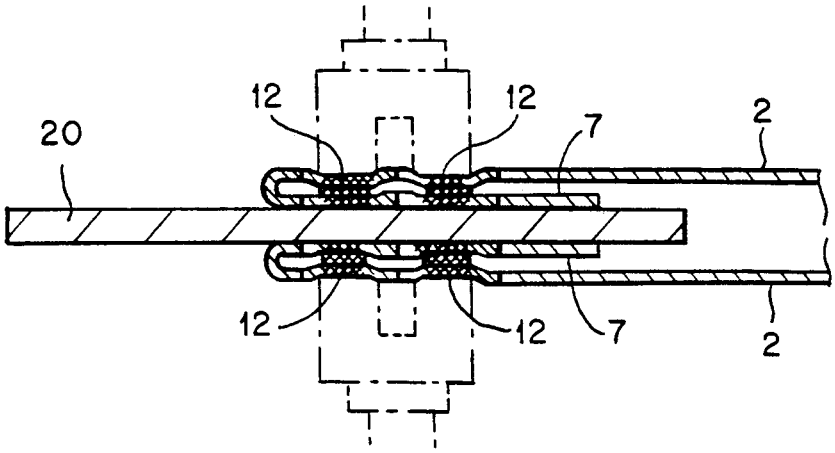
FIG. 11B is another enlarged cross section of the portion which extends along the line 11—11 in FIG. 10 and has been fusion-welded.

Next, the raw material "F" will successively be moved leftwards and so that, as shown in FIGS. 10 and 11A, each pair of ribbon-like constituent strings 10*a* and 11*a* are laid in parallel at a predetermined distance between them, between each inwardly folded tab 7 and the front or back wall 2. The raw material "F" which now carries the constituent strings 10*a* and 11*a* will then be moved further to the left so that, also as shown in FIGS. 10 and 11A, a heat resistant rigid plate 20 is inserted in between the tab 7 extending from the front wall 2 and the other tab 7 extending from the back wall 2. The heat resistant rigid plate 20 is fixed in position in this manufacture line, and is preferably made of a metal plate whose surfaces are covered with a heat resistant material such as a silicone resin or "Teflon" (trademark). As the leading phantom line shown in FIG. 10 reaches the place where the plate 20 is located, a pair of upper and lower hot dies "X" will press the regions each encircled with the breakable joint 13 and the phantom line as well as other portions located close to the regions. As a result, one tab 7 is fusion-welded to the front wall 2, with the other tab 7 is simultaneously fusion-welded to the back wall 2, as will be seen in FIGS. 10 and 11B.

Figure 12:
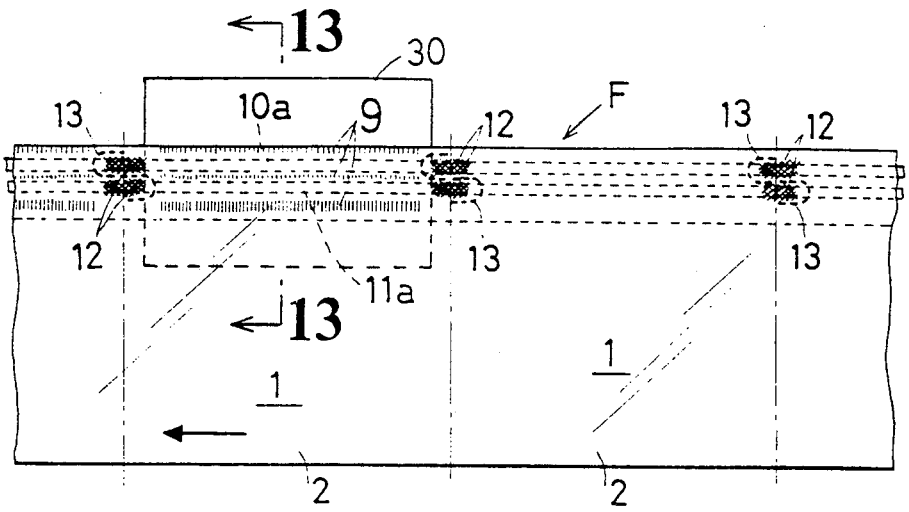
FIG. 12 is a plan view showing the third step which follows the second step shown in FIG. 10 and is carried out to manufacture the bag in the embodiment.
Figure 13A:
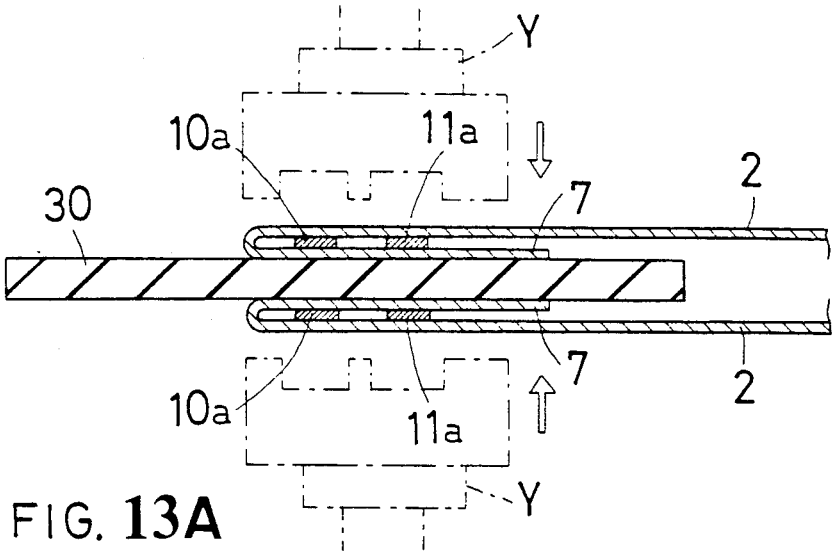
FIG. 13A is an enlarged cross section of the portion which extends along the line 13—13 in FIG. 12 but is not knurled yet.
Figure 13B:
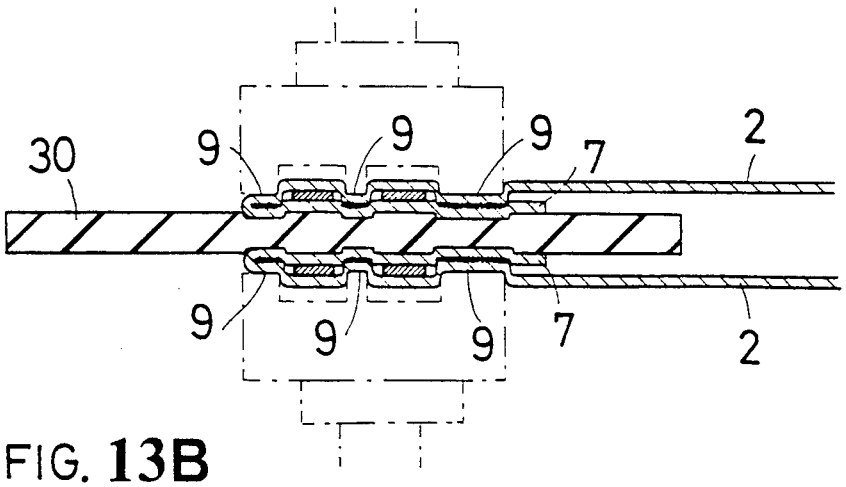
FIG. 13B is another enlarged cross section of the portion which extends along the line 13—13 in FIG. 12 and has been knurled.

The raw material "F" of the bag will further be transported leftwards so that, as shown in FIGS. 12 and 13A, a soft and heat-resistant knurling plate 30 is inserted in between the tab 7 extending from the front wall 2 and the other tab 7 extending from the back wall 2. The heat-resistant knurling plate 30 is fixed in position in the manufacture line, and is made of a soft material such as a silicone rubber.

Subsequently, the bag material "F" will further advance so that its part enclosed by the phantom lines in FIG. 12 will arrive at a region where the knurling plate 30 is located. At this region of the manufacture line, a pair of upper and lower hot knurling dies "Y" will press three zones of the bag material in a manner as indicated by the phantom lines in FIG. 13B. However, those dies will not press the material's portions through which the drawstrings 10*a* and 11*a* have been inserted between the tab 7 and the front wall 2 and between the other tab 4 and the back wall 2. Thus, three knurled lines are formed parallel and one above another, with each of them being composed of a number of indentations 9.

Figure 14:
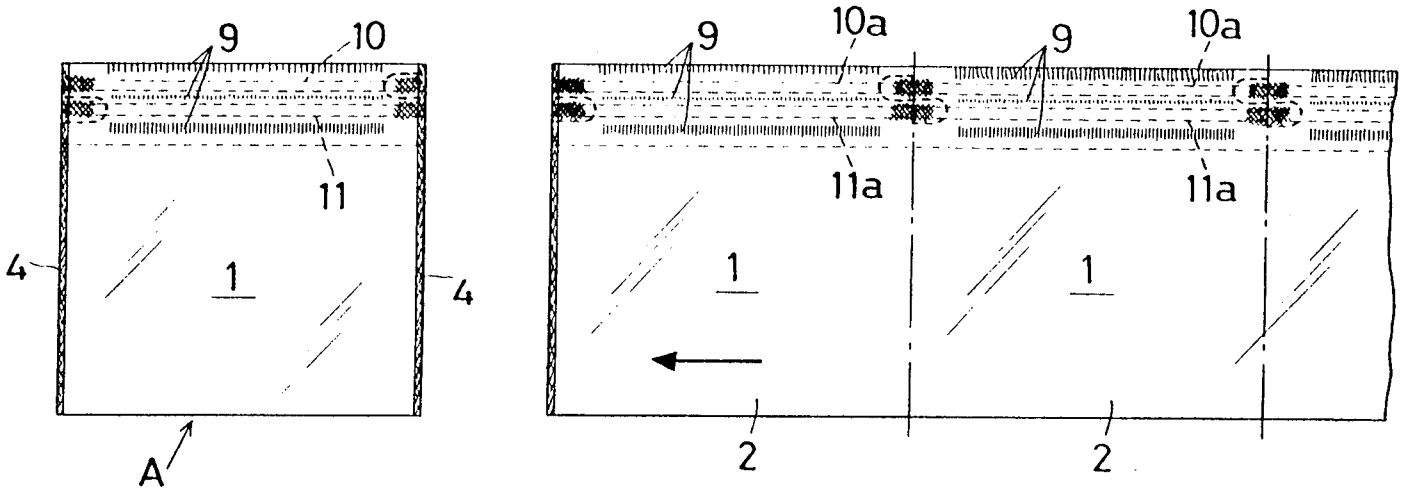
FIG. 14 is a plan view showing the fourth step which follows the third step shown in FIG. 12 and is carried out to manufacture the bag in the embodiment.
Figure 15:
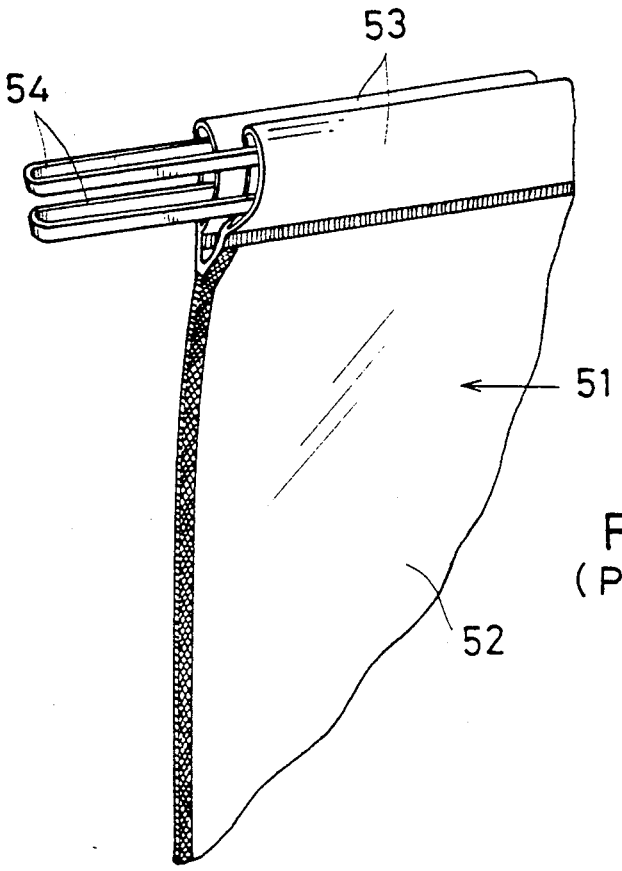
FIG. 15 ( Prior Art )
FIG. 15 is an enlarged perspective view showing in part a prior art packing bag with drawstrings.
Figure 16:
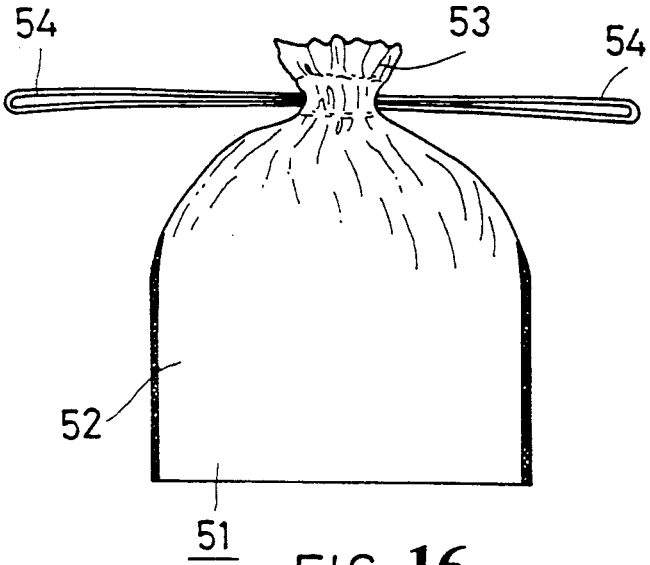
FIG. 16 ( Prior Art )
FIG. 16 is a perspective view showing in entirety the prior art packing bag, with its top end being closed.

Finally, the bag material "F" further advances leftwards so as to be fusion-welded along the phantom lines and in a successive manner shown in FIG. 14. This step itself is the step of simultaneously hot-melt severing from the material the packing bags "A" with drawstrings shown in FIGS. 1 and 2.

In use of the packing bag thus manufactured, the upper and lower drawstrings 10 and 11 are pinched at their welded areas 12, which are located opposite to serve as the operable portions, and are tightened in opposite directions tearing the breakable joints 13 so as to gather and close the top end of the bag.

In this gathered state, both the sleeves 5 are pleated so that their pleats overlap one another. The indentations 9 engage with each other to thereby afford a high frictional resistance to the contact surfaces of the sleeves, as will be seen in FIG. 7. Additionally, those sleeves 5 are rendered less resilient or less stiff by the number of indentations 9 so as not to easily return to their natural or ungathered state. Further, friction between the drawstrings 10 and 11 and the inner surfaces of the sleeves 5 in which the drawstrings are accommodated will also be useful to maintain the closed state of the bag. In this way, the top end of the packing bag will securely remain gathered and tightly closed.

In summary, the packing bag having the drawstrings and constructed in a manner as described herein is advantageous in that the fastened drawstrings can keep tight the closed top end so that any articles are surely held in the bag.

The plurality of engaging portions such as the indentations can be formed easily at the same time as the main body is formed. Therefore, it is also advantageous that the packing bag in the present invention is suited to mechanical production at a manufacture cost comparable to that of the conventional packing bags.

What is claimed is:

1. A packing bag having drawstrings, which bag comprises:

a main body made of synthetic resin film or sheet and having sleeves formed around an open top end of the bag so as to accommodate the drawstrings;

each drawstring being of an annular shape, inserted in the sleeves around the open top end and capable of being tightened to gather and close it;

a plurality of engaging portions formed on surfaces of the sleeves, with the engaging portions increasing a friction between the surfaces which come into contact with one another in a gathered state of the bag's top end, and further with the engaging portions being such that stiffness of the sleeves is reduced to render them less restorable to their ungathered state;

wherein the engaging portions are knurled indentations which are formed longitudinally of the sleeves, at predetermined intervals and in parallel with each other, wherein each sleeve comprises a tab extending from the top end and a front or back wall of the main body, which wall has a surface opposite to the tab, wherein each sleeve is formed by tightly welding the wall to the tab at its lower end and middle zone extending longitudinally of the sleeves, whereby a lower junction line and a middle junction line are formed, with the middle junction line dividing the sleeve into an upper internal chamber and a lower internal chamber, wherein each sleeve accommodates an upper drawstring and a lower drawstring which are disposed above and below the middle junction line, respectively, wherein each sleeve has as the engaging portions a plurality of parallel indentations formed at predetermined intervals along the sleeve, and wherein bottoms of the indentations extend into the tab so that the tab is securely connected to the wall, wherein the bottoms of the indentations are fusion-welded integral with each other, and wherein each drawstring is welded integral with the sleeve but separable therefrom at one end to provide the sleeve with an operable portion, whereas at other end opposite to the operable portion of each drawstring it is permanently attached to the sleeve.

2. A packing bag as defined in claim 1, wherein each sleeve has a breakable joint formed adjacent to the operable portion of the drawstring.

* * * * *